US007140888B1

(12) United States Patent
Chan

(10) Patent No.: US 7,140,888 B1
(45) Date of Patent: Nov. 28, 2006

(54) TRACK LIGHTING

(76) Inventor: Teng-Chiung Chan, 21, Lane 68, Minsheng St., Sioushuei Township, Changhua County (TW)

( * ) Notice: Subject to any disclaimer, the term of this patent is extended or adjusted under 35 U.S.C. 154(b) by 100 days.

(21) Appl. No.: 11/183,617

(22) Filed: Jul. 18, 2005

(51) Int. Cl.
*H01R 25/00* (2006.01)

(52) U.S. Cl. ..... 439/119; 439/121

(58) Field of Classification Search ..... 439/119, 439/121, 122, 116; 362/422, 431, 430, 418
See application file for complete search history.

(56) References Cited

U.S. PATENT DOCUMENTS 3,611,252 A * 10/1971 Fremont ..... 439/118
3,832,673 A * 8/1974 Le Hir ..... 439/110
3,980,368 A * 9/1976 Fremont ..... 439/94
4,032,208 A * 6/1977 Berkenhoff ..... 439/122
4,092,507 A * 5/1978 Lawrence ..... 200/51 R
4,108,523 A * 8/1978 Bolis ..... 439/116
4,699,439 A * 10/1987 Cohen ..... 439/207
4,729,742 A * 3/1988 Onishi et al. ..... 439/208
4,768,964 A * 9/1988 Zucchini ..... 439/110
4,776,809 A * 10/1988 Hall ..... 439/116
4,778,397 A * 10/1988 Contant et al. ..... 439/116
4,822,292 A * 4/1989 Thayer et al. ..... 439/207
4,919,625 A * 4/1990 Coutre ..... 439/118
5,013,251 A * 5/1991 Stringer et al. ..... 439/94
5,334,037 A * 8/1994 Gabrius et al. ..... 439/118
5,603,622 A * 2/1997 Lin ..... 439/121
5,855,485 A * 1/1999 Patti ..... 439/121
6,059,582 A * 5/2000 Tsai ..... 439/121
6,079,992 A * 6/2000 Kuchar et al. ..... 439/122
6,203,339 B1 * 3/2001 Nieminen ..... 439/118
6,334,895 B1 * 1/2002 Bland ..... 106/705
6,884,095 B1 * 4/2005 Tsai ..... 439/121
7,011,534 B1 * 3/2006 Shen ..... 439/119

* cited by examiner

*Primary Examiner*—Alexander Gilman
(74) *Attorney, Agent, or Firm*—Alan D. Kamrath; Nikolai & Mersereau, P.A.

(57) ABSTRACT

A track lighting includes a housing, a support member, a limit board, a connecting bar, a first contact, a second contact, a rail, two insulating jackets, two conductors, a seat, a contact lever, an upper cover, and a spring. The spring biased between the upper cover and the seat provides an tensile force to press the upper portion of the contact lever so that the contact lever and the second contact will contact with the two conductors closely and exactly. Thus, the track lighting has a closely electrical connection without producing an electrical disconnection or a short circuit.

15 Claims, 3 Drawing Sheets

TRACK LIGHTING

BACKGROUND OF THE INVENTION

1. Field of the Invention

The present invention relates to a track lighting, and more particularly to a track lighting having a spot slidable on the rail freely.

2. Description of the Related Art

A conventional track lighting comprises a track, and a plurality of spots slidably mounted on the track. Thus, the spots are slidable on the track freely to adjust the optical angles for different working requirements. However, the spots are slidable on the track frequently so that the electric wires are easily tangled or worn out during a long-term utilization, thereby producing an electrical disconnection or a short circuit.

SUMMARY OF THE INVENTION

In accordance with the present invention, there is provided a track lighting, comprising a housing, a support member mounted in the housing, a limit board mounted on a lower portion of the support member to limit a connecting bar, a first contact and a second contact, a rail mounted in the support member and having an upper portion and a lower portion each formed with a track, two insulating jackets each mounted in the respective track of the rail, two conductors each mounted in and covered by a respective one of the insulating jackets, wherein a lower one of the two conductors is connected to the second contact, a seat mounted in the housing and rested on the rail, a contact lever extended from a lower portion of the seat and connected to the connecting bar and an upper one of the two conductors, an upper cover mounted on an upper portion of the housing, and a spring biased between the upper cover and the seat.

The primary objective of the present invention is to provide a track lighting having a closely electrical connection without producing an electrical disconnection or a short circuit.

Another objective of the present invention is to provide a track lighting, wherein the spring biased between the upper cover and the seat provides an tensile force to press the upper portion of the contact lever so that the contact lever and the second contact will contact with the two conductors closely and exactly.

Further benefits and advantages of the present invention will become apparent after a careful reading of the detailed description with appropriate reference to the accompanying drawings.

DETAILED DESCRIPTION OF THE INVENTION

Figure 1:
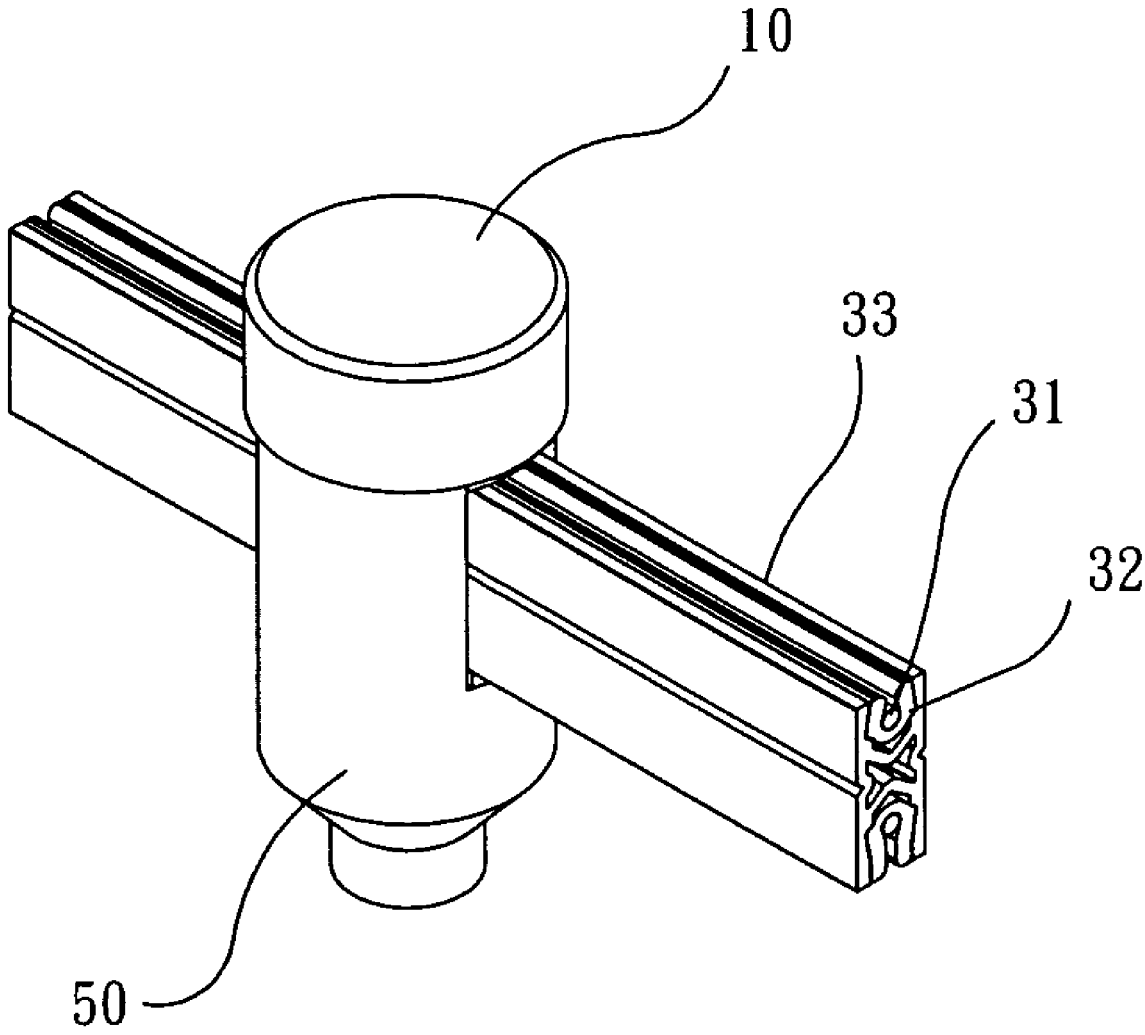
FIG. 1 is a perspective view of a track lighting in accordance with the preferred embodiment of the present invention.
Figure 2:
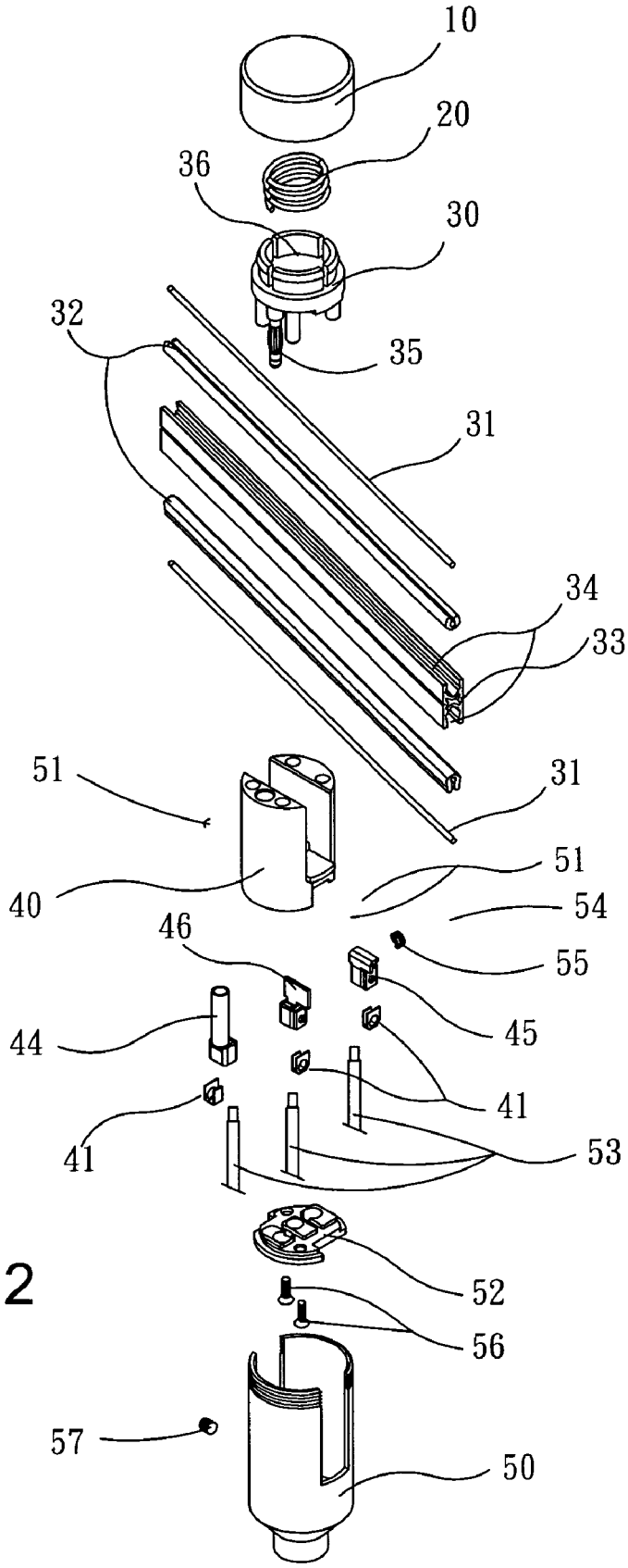
FIG. 2 is an exploded perspective view of the track lighting as shown in FIG. 1.

Referring to the drawings and initially to FIGS. 1 and 2, a track lighting in accordance with the preferred embodiment of the present invention comprises a housing 50, a support member 40 mounted in the housing 50, a limit board 52 mounted on a lower portion of the support member 40 to limit a connecting bar 44, a first contact 45 and a second contact 46, a rail 33 mounted in the support member 40 and having an upper portion and a lower portion each formed with a track 34, two insulating jackets 32 each mounted in the respective track 34 of the rail 33, two conductors 31 each mounted in and covered by a respective one of the insulating jackets 32, wherein a lower one of the two conductors 31 is connected to the second contact 46, a seat 30 mounted in the housing 50 and rested on the rail 33, a contact lever 35 extended from a lower portion of the seat 30 and connected to the connecting bar 44 and an upper one of the two conductors 31, an upper cover 10 mounted on an upper portion of the housing 50, and a spring 20 biased between the upper cover 10 and the seat 30 so that the contact lever 35 and the second contact 46 contact with the two conductors 31 closely and exactly.

Figure 3:
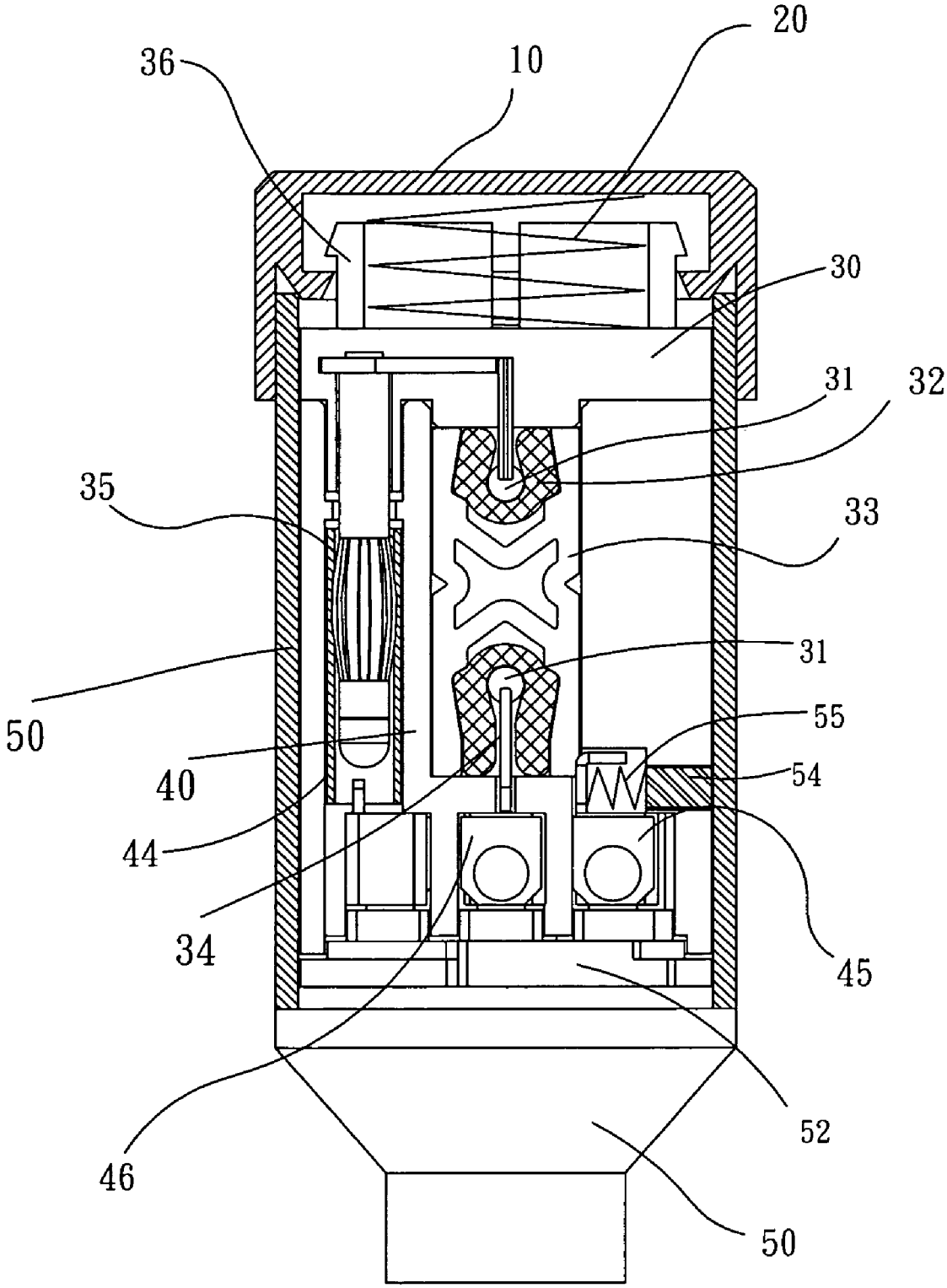
FIG. 3 is a plan cross-sectional view of the track lighting as shown in FIG. 1.

Referring to FIGS. 1–3, the upper cover 10 is a hollow body. The seat 30 has an inside formed with a chamber 36 for mounting the spring 20. The rail 33 has a substantially H-shaped cross-sectional profile, and the track 34 of the rail 33 has a substantially U-shaped cross-sectional profile. The two conductors 31 are connected to positive and negative electrodes of an electric power supply (not shown) respectively. The support member 40 has a substantially U-shaped cross-sectional profile to limit the rail 33, the insulating jackets 32 and the conductors 31. Each of the connecting bar 44, the first contact 45 and the second contact 46 has a lower portion provided with a reed 41 for connecting three electric wires 53.

The track lighting further comprises three screws 51 extended through the support member 40 and locked onto the connecting bar 44, the first contact 45 and the second contact 46 to press the reeds 41 and the electric wires 53.

The track lighting further comprises a hex screw 54 locked onto the support member 40 to press an elastic member 55 which presses the first contact 45 toward a side face of the rail 33 so that the first contact 45 is rested on the side face of the rail 33 closely.

The track lighting further comprises a plurality of locking screws 56 extended through the limit board 52 and locked onto the support member 40 to limit the connecting bar 44, the first contact 45 and the second contact 46 in the support member 40.

The track lighting further comprises a fixing screw 57 locked onto the housing 50 to press the support member 40 so that the housing 50 and the support member 40 are combined together.

As shown in FIG. 3, the contact lever 35 has a lower portion movably extended through the connecting bar 44 and an upper portion closely connected to the upper conductor 31 in the rail 33. At this time, the spring 20 biased between the upper cover 10 and the seat 30 provides an tensile force to press the upper portion of the contact lever 35 so that the contact lever 35 and the second contact 46 contact with the two conductors 31 closely and exactly. Thus, the spot (not shown) is slidable on the rail 33 freely.

Accordingly, the spring 20 biased between the upper cover 10 and the seat 30 provides an tensile force to press the upper portion of the contact lever 35 so that the contact lever 35 and the second contact 46 contact with the two conductors 31 closely and exactly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A track lighting, comprising:

a housing;

a support member mounted in the housing;

a limit board mounted on a lower portion of the support member to limit a connecting bar, a first contact and a second contact;

a rail mounted in the support member and having an upper portion and a lower portion each formed with a track;

two insulating jackets each mounted in the respective track of the rail;

two conductors each mounted in and covered by a respective one of the insulating jackets, wherein a lower one of the two conductors is connected to the second contact;

a seat mounted in the housing and rested on the rail;

a contact lever extended from a lower portion of the seat and connected to the connecting bar and an upper one of the two conductors;

an upper cover mounted on an upper portion of the housing;

a spring biased between the upper cover and the seat.

2. The track lighting in accordance with claim 1, wherein the contact lever and the second contact will contact with the two conductors closely and exactly by an electric force of the spring.

3. The track lighting in accordance with claim 1, wherein the contact lever has a lower portion movably extended through the connecting bar.

4. The track lighting in accordance with claim 1, wherein the upper cover is a hollow body.

5. The track lighting in accordance with claim 1, wherein the seat has an inside formed with a chamber for mounting the spring.

6. The track lighting in accordance with claim 1 wherein the rail has a substantially H-shaped cross-sectional profile.

7. The track lighting in accordance with claim 1, wherein the track of the rail has a substantially U-shaped cross-sectional profile.

8. The track lighting in accordance with claim 1, wherein the support member has a substantially U-shaped cross-sectional profile to limit the rail, the insulating jackets and the conductors.

9. The track lighting in accordance with claim 1, further comprising a hex screw locked onto the support member to press an elastic member which presses the first contact toward a side face of the rail so that the first contact is rested on the side face of the rail closely.

10. The track lighting in accordance with claim 1, further comprising a plurality of locking screws extended through the limit board and locked onto the support member to limit the connecting bar, the first contact and the second contact in the support member.

11. The track lighting in accordance with claim 1, further comprising a fixing screw locked onto the housing to press the support member so that the housing and the support member are combined together.

12. The track lighting in accordance with claim 1, wherein the contact lever has an upper portion closely connected to the upper conductor in the rail.

13. The track lighting in accordance with claim 12, wherein the spring biased between the upper cover and the seat provides an tensile force to press the upper portion of the contact lever so that the contact lever and the second contact will contact with the two conductors closely and exactly.

14. The track lighting in accordance with claim 1, wherein each of the connecting bar, the first contact and the second contact has a lower portion provided with a reed for connecting three electric wires.

15. The track lighting in accordance with claim 14, further comprising three screws extended through the support member and locked onto the connecting bar, the first contact and the second contact to press the reeds and the electric wires.

* * * * *